US007472500B2

(12) United States Patent
White, III

(10) Patent No.: US 7,472,500 B2
(45) Date of Patent: Jan. 6, 2009

(54) SNOWTHROWER DEFLECTOR CONTROL

(75) Inventor: Donald M. White, III, Chanhassen, MN (US)

(73) Assignee: The Toro Company, Bloomington, MN (US)

( * ) Notice: Subject to any disclaimer, the term of this patent is extended or adjusted under 35 U.S.C. 154(b) by 20 days.

(21) Appl. No.: 11/650,362

(22) Filed: Jan. 5, 2007

(65) Prior Publication Data

US 2008/0163521 A1 Jul. 10, 2008

(51) Int. Cl.
*E01H 5/09* (2006.01)

(52) U.S. Cl. ..... 37/262; 37/260; 292/336.3

(58) Field of Classification Search ..... 37/257–262; 49/451; 292/200, 336.3; 193/15; 254/120, 254/DIG. 12

See application file for complete search history.

(56) References Cited

U.S. PATENT DOCUMENTS 824,006 A * 6/1906 Glennon ..... 74/535
2,453,648 A * 11/1948 Wagner ..... 219/138
2,735,199 A 2/1956 Wanner et al.
2,768,453 A 10/1956 Adams, Jr.
3,655,212 A * 4/1972 Krass et al. ..... 280/641
3,828,450 A * 8/1974 Boeck ..... 37/260
4,255,881 A * 3/1981 Fralish ..... 37/260
5,083,387 A 1/1992 Tillotson et al.
5,315,771 A * 5/1994 White et al. ..... 37/260
6,470,602 B2 * 10/2002 White et al. ..... 37/244
6,913,315 B2 * 7/2005 Ball et al. ..... 297/284.7
7,032,333 B2 4/2006 Friberg et al.
2005/0006930 A1 * 1/2005 Nolan et al. ..... 297/153

* cited by examiner

*Primary Examiner*—Thomas B Will
*Assistant Examiner*—Mai T Nguyen
(74) *Attorney, Agent, or Firm*—James W. Miller

(57) ABSTRACT

A U-shaped handle is physically attached to the back of a deflector atop a snow directing chute on a snowthrower. The deflector pivots atop the chute to adjust the trajectory of a stream of snow being thrown by the snowthrower. The handle is gripped and moved up and down to effect a pivotal adjustment of the deflector. A pivotal latch is carried on the handle which latch protrudes into the open interior hand grip space of the handle. The latch is spring biased so that a detent on the latch engages with a toothed rack with the interengagement between the detent and the rack holding the deflector in an adjusted position. When the operator grips the handle and squeezes the fingers of the gripping hand closed, the latch is pivoted to remove the detent from the rack and thereby permit pivotal adjustment of the deflector.

15 Claims, 5 Drawing Sheets

SNOWTHROWER DEFLECTOR CONTROL

TECHNICAL FIELD

This invention relates to snowthrowers having a rotatable chute for adjusting the direction of a snow stream thrown by the snowthrower. More particularly, this invention relates to a pivotal deflector atop the chute for further adjusting the angle of trajectory of the snow stream.

BACKGROUND OF THE INVENTION

Snowthrowers are known having upright chutes through which a snow stream is thrown. Such chutes are rotatable about a vertical axis to vary the direction of the snow stream being thrown through the chute relative to the snowthrower. If the chute points forwardly, then the snow stream will be thrown forwardly in front of the snowthrower. However, if the chute is rotated to one side or the other, then the snow stream will be thrown laterally to the side to which the chute is directed. The chute can be left in intermediate rotated positions where the snow stream is thrown both partially forwardly and partially to one side.

Most snowthrowers having rotatable chutes usually have a pivotal deflector atop the chute. The angle of inclination of the deflector on the chute controls the trajectory of the snow stream. The deflector is usually formed with an integral handle. The user can grab the handle to manually move the deflector to an adjusted position. The friction between the deflector and the chute retains the deflector in an adjusted position.

While the use of friction to hold the deflector in place is effective, the friction between the deflector and the chute must be quite strong in order to do this. Thus, the deflector often feels very stiff when the operator grabs the handle to adjust the deflector. The operator must sometimes apply a great deal of force to pivotally adjust the deflector. This can be difficult for some operators to do.

U.S. Pat. No. 7,032,333, which is owned by the assignee of this invention, discloses a deflector that is remotely operated by a pivotal control handle carried on the rearwardly and upwardly extending handle assembly of the snowthrower, rather than by a handle physically attached to the deflector. The control handle is coupled by a mechanical linkage to the deflector. A positive latch is provided in the linkage to lock the position of the deflector in place. Thus, the friction between the deflector and the chute can be lessened since a latch takes the place of the friction.

However, the approach disclosed in the 333 patent, namely the use of a remotely located control handle and a mechanical connecting linkage, is more complex and costly. It is not well suited from an expense standpoint for use on smaller, less expensive snowthrowers. The use of a simple handle directly and physically attached to the deflector is far less expensive and is the simplest way of physically pivoting the deflector. However, there is a need in the snowthrower art to be able to more easily move such a deflector but to have the deflector securely remain in any adjusted position.

SUMMARY OF THE INVENTION

One aspect of this invention relates to a snowthrower of the type having a chute rotatable about a substantially vertical axis for directing a snow stream, a deflector carried on the chute with the deflector being pivotal relative to the chute for adjusting the trajectory of the snow stream, and a control on the snowthrower for operating the deflector. The improvement relates to the control which comprises a handle on the deflector to allow an operator to grip the handle to pivot the deflector. A movable latch is carried on the deflector, the latch being movable on the deflector between an engaged position in which the deflector is locked against being pivoted and a disengaged position in which the deflector is free to be pivoted. The latch is configured and oriented relative to the handle such that the latch is moved between the engaged and disengaged positions thereof when the operator grips both a portion of the latch and the handle with one hand and the operator squeezes the fingers of the gripping hand closed on the handle.

Another aspect of this invention relates to a snowthrower of the type having a chute rotatable about a substantially vertical axis for directing a snow stream, a deflector carried on the chute with the deflector being pivotal relative to the chute for adjusting the trajectory of the snow stream, and a control on the snowthrower for operating the deflector. The improvement relates to the control which comprises a U-shaped handle on the deflector with the handle comprising a pair of spaced side walls and a rear wall with the rear wall being spaced behind a back wall of the deflector and with the side walls of the handle joining the rear wall of the handle to the back wall of the deflector. A locking member is fixed to a back of the chute with the locking member extending through the handle between the side walls thereof and in front of the rear wall of the handle such that the handle traverses back and forth over the locking member as the deflector is adjusted. A movable latch is carried on the handle. The latch is configured to interengage with the locking member to hold the deflector in place when the latch is moved into an engaged position, the latch being selectively movable by the operator into a disengaged position in which the interengagement between the latch and the locking member is broken to thereby permit the deflector to be adjusted.

Yet another aspect of this invention relates to a snowthrower which comprises a frame. Snow removal components are provided on the frame for gathering snow from the ground and for throwing the gathered snow in a snow stream away from the snowthrower. A rotatable chute on the frame directs the snow stream in different directions depending on the rotational position of the chute. A pivotal deflector atop the chute adjusts an angle of trajectory of the snow stream. A handle assembly on the snowthrower has at least one upwardly and rearwardly extending handle tube connected to the frame. A U-shaped handle is fixed to a back wall of the deflector. A pivotal latch is carried on the handle. A toothed rack is carried on a back wall of the chute. A spring biases the latch such that a detent on the latch normally engages with the rack with the interengagement between the detent and the rack holding the deflector in an adjusted position. The latch is selectively pivoted to remove the detent from the rack and thereby permit pivotal adjustment of the deflector whenever the operator grips the handle and squeezes the fingers of the gripping hand closed.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

One embodiment of a snowthrower chute control according to this invention is illustrated generally as 2 in FIGS. 1-8. A typical snowthrower of the type with which control 2 may be used is illustrated generally as 4. Snowthrower 4 may be any snowthrower incorporating suitable snow removal components for gathering snow from the ground and for throwing the gathered snow in a snow stream away from the snowthrower. Thus, snowthrower 4 may be either a single stage snowthrower having a single snow gathering and throwing impeller 5. Alternatively, snowthrower 4 could be a two stage snowthrower having an auger for gathering snow as well as an impeller for throwing the snow gathered by the auger.

Figure 1:
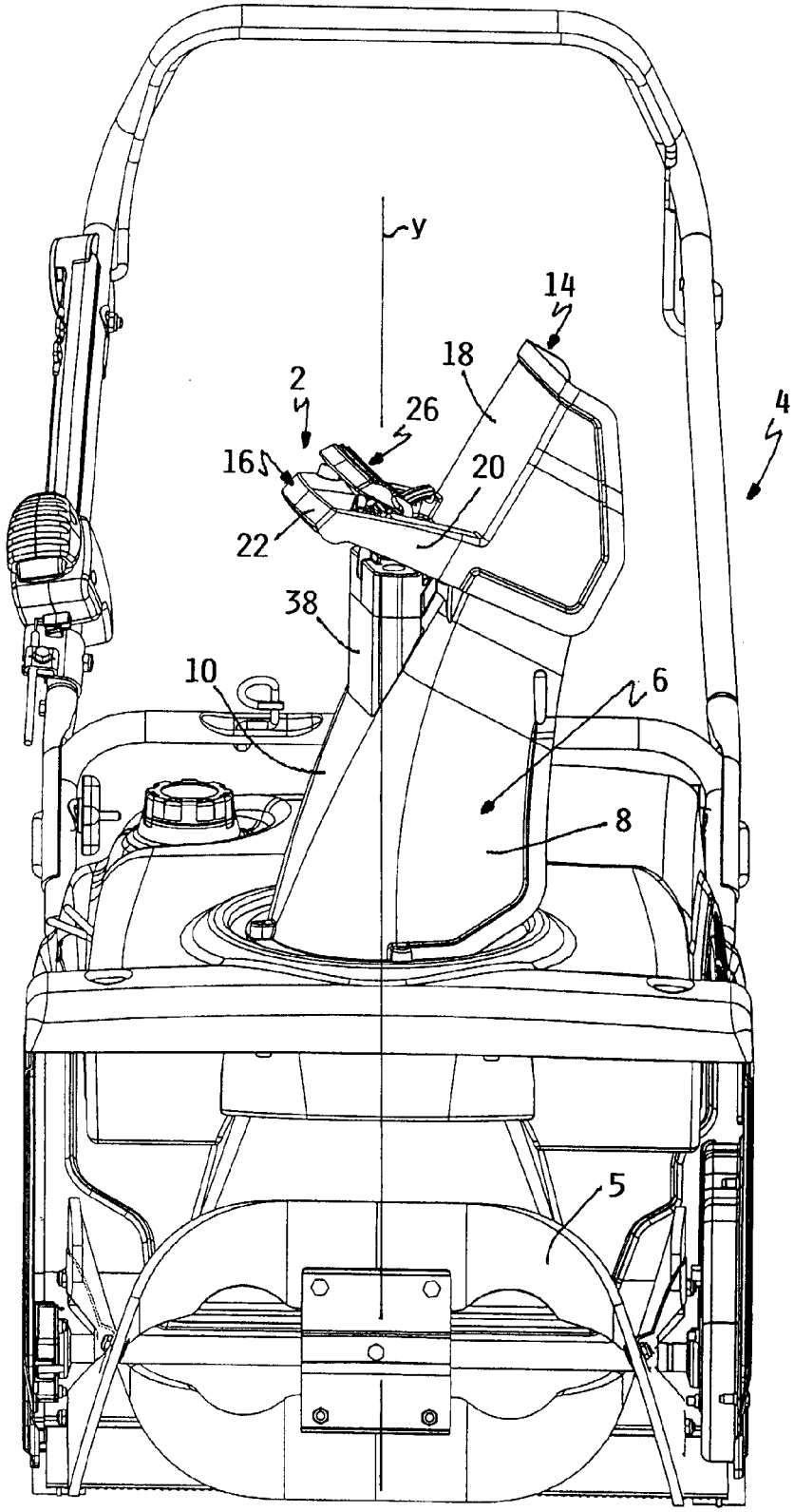
FIG. 1 is a front plan view of a snowthrower having a deflector control according to this invention.
Figure 2:
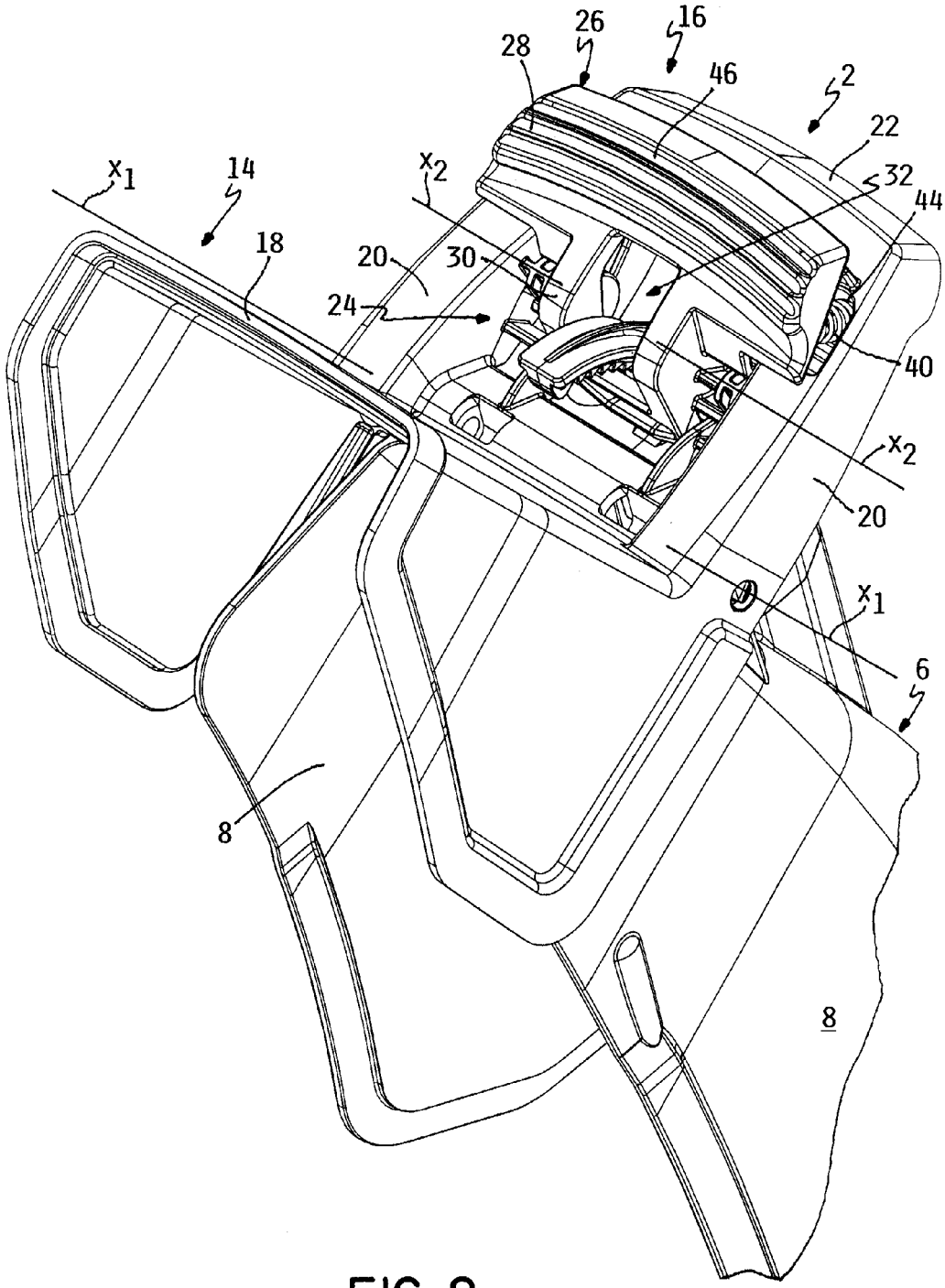
FIG. 2 is a perspective view from above and to the front of the deflector control of FIG. 1.
Figure 3:
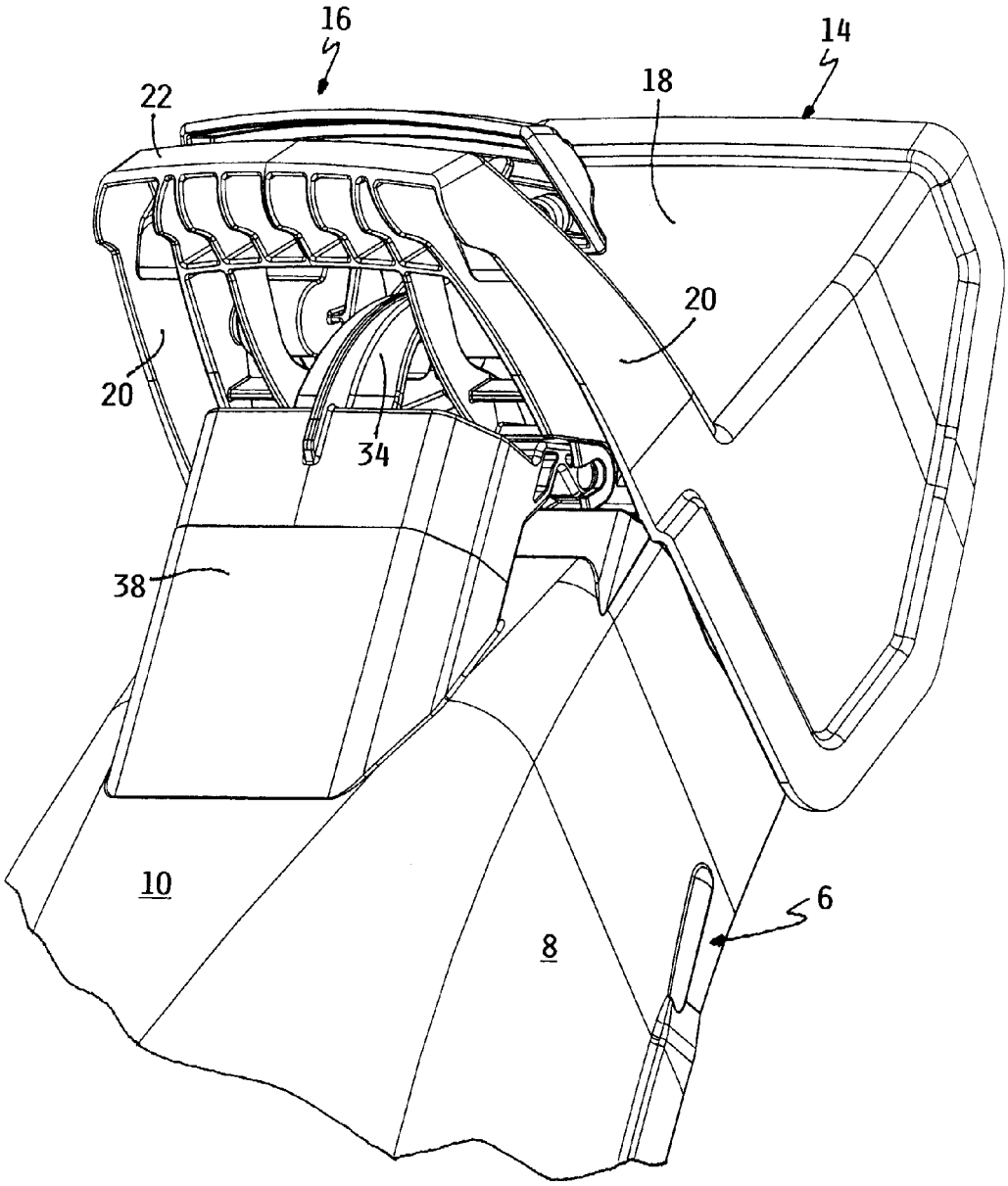
FIG. 3 is a perspective view similar to FIG. 2, but from behind and below the deflector control of FIG. 1.

Snowthrower 4 is also of the type having a generally upright or vertically extending chute 6 through which the snow stream is thrown. As shown in FIGS. 1 and 2, chute 6 is generally U-shaped having spaced, parallel side walls 8 connected together by a back wall 10. The bottom or base of chute 6 is fixed to a ring (not shown) that serves to rotatably mount chute 6 on snowthrower 4 for rotation about a generally vertical axis y. See FIG. 1. Rotation of chute 6 about vertical axis y adjusts the direction of the snow stream relative to snowthrower 4 as will be described more fully hereafter.

The top of chute 6 carries a pivotal deflector 14. Deflector 14 is also U-shaped but is slightly larger than the top of chute 6 such that the top of chute 6 nests within the bottom of deflector 14. Deflector 14 pivots on the top of chute 6 about a generally horizontal axis $x_1$. See FIG. 2. Pivoting of deflector 14 about generally horizontal axis $x_1$ adjusts the trajectory of the snow stream being thrown by chute 6. However, pivotal deflector 14 forms no part of this invention and could be deleted from chute 6 if so desired.

Rotatable chute 6 and pivotal deflector 14 as disclosed herein are of the type commonly found on snowthrowers. There is nothing novel about chute 6 and deflector 14 per se. Rather, this invention relates to a control 2 for pivoting deflector 14 about horizontal axis $x_1$.

Referring now to FIGS. 2-5, deflector control 2 of this invention includes a U-shaped handle 16 that is fixed to the back wall 18 of deflector 14. Handle 16 includes left and right side walls 20 that are joined together by a rear wall 22. Rear wall 22 of handle 16 is spaced behind back wall 18 of deflector 14 by the length of side walls 20 of handle 16. The space between side walls 20 of handle 16 and between rear wall 22 of handle 16 and back wall 18 of deflector 14 provides an open hand grip space 24. The user can place his or her hand atop rear wall 22 of handle 16 and curl his or her fingers down into hand grip space 24 in order to grasp handle 16 to pivot deflector 14 about the horizontal pivot axis $x_1$.

A deflector latch 26 is mounted within hand grip space 24 for pivoting about a second horizontal pivotal axis denoted generally as $x_2$. Latch 26 is T-shaped having a relatively wide head 28 and a narrower stem 30 that projects downwardly from one side of head 28. Head 28 of latch 26 is approximately as wide as the width of handle 16 such that the sides of head 28 overlie side walls 20 of handle 16. Stem 30 of latch 26 is narrow enough to fit down into hand grip space 24.

Stem 30 of latch 26 has a bent or compound shape relative to head 28 of latch 26. Stem 30 first extends forwardly towards back wall 18 of the chute and then bends fairly sharply downwardly with the remainder of stem 30 extending vertically down into hand grip space 24 between side walls 20 of handle 16. A slot 32 is provided in stem 30 of latch 26 to allow passage of a toothed rack 34. The very lower edge of stem 30 underlying slot 32 is provided with at least one, and preferably two, detents 36 whose shape correspond generally to the shape of teeth 35 in rack 34. See FIG. 4 which shows detents 36 on latch 26 in engagement with some of the grooves between adjacent teeth 35 in rack 34.

Rack 34 is fixed to back wall 10 of chute 6 by a post or column 38 that is integrally molded to back wall 10 of chute 6. Rack 34 is integrally molded to post or column 38. Rack 34 itself extends over an arcuate sector of about 90° and is formed as a curved finger pointing forwardly towards back wall 18 of deflector 14. Rack 34 extends through slot 32 in latch 26 and teeth 35 of rack 34 are carried on the underside of rack 34 facing detents 36 on the lower edge of stem 30 of latch 26. See FIG. 4.

Figure 4:
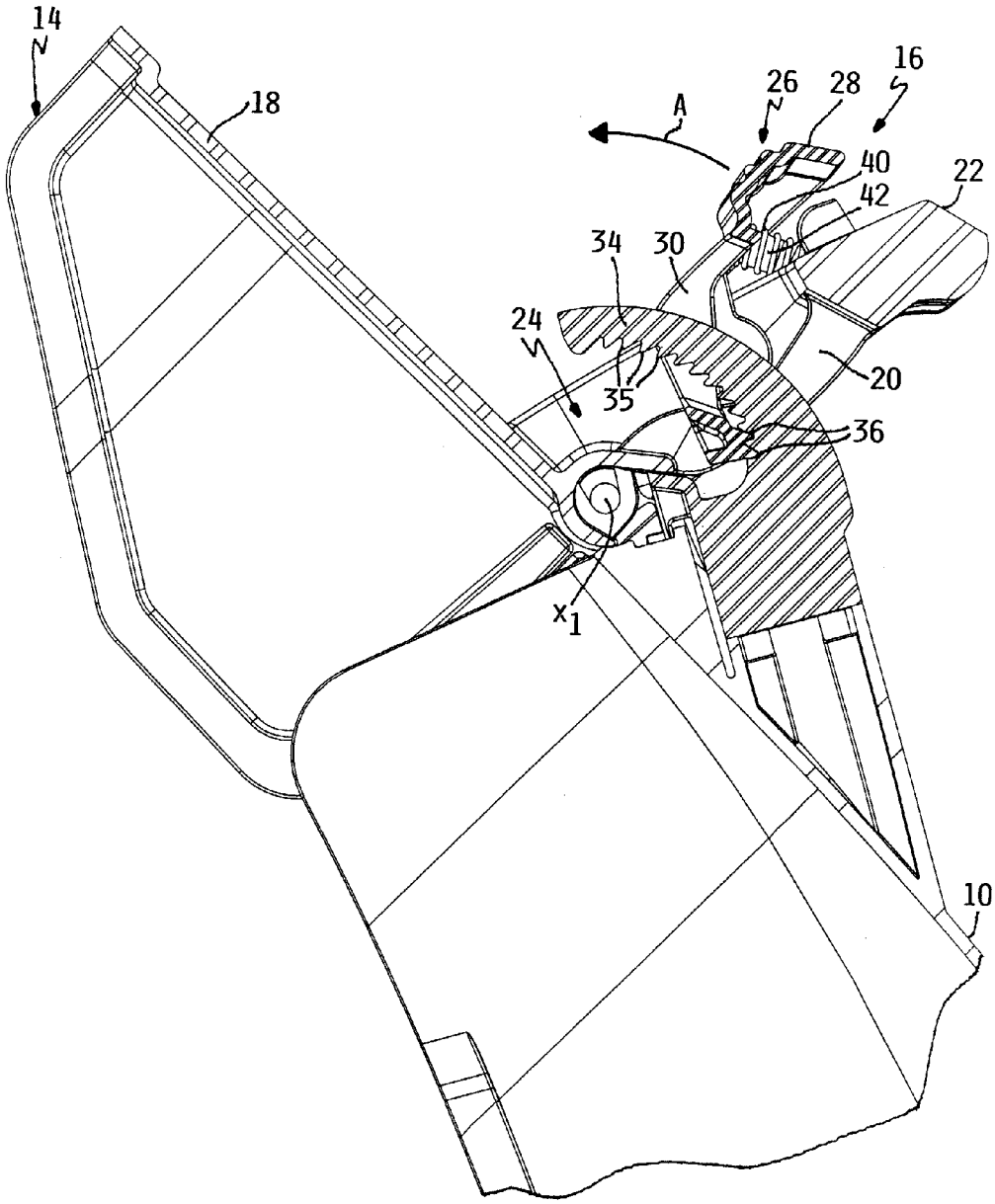
FIG. 4 is a cross-sectional view through the deflector control of this invention, particularly illustrating the deflector latch in an engaged position.

Latch 26 is spring biased into the engaged position shown in FIG. 4. This is accomplished by a pair of biasing springs 40 that are received around pegs 42 on the underside of head 28 of latch 26. See FIG. 4. The other ends of springs 40 are captured and retained in any suitable manner in cavities or recesses 44 on some portion of handle 16. See FIG. 2. Thus, springs 40 exert a biasing force on head 28 of latch 26 which rotates latch 26 about the horizontal pivot axis $x_2$ in the direction of the arrow A in FIG. 4. This rotation continues until detents 36 on latch 26 engage with teeth 35 on the underside of rack 34.

Figure 5:
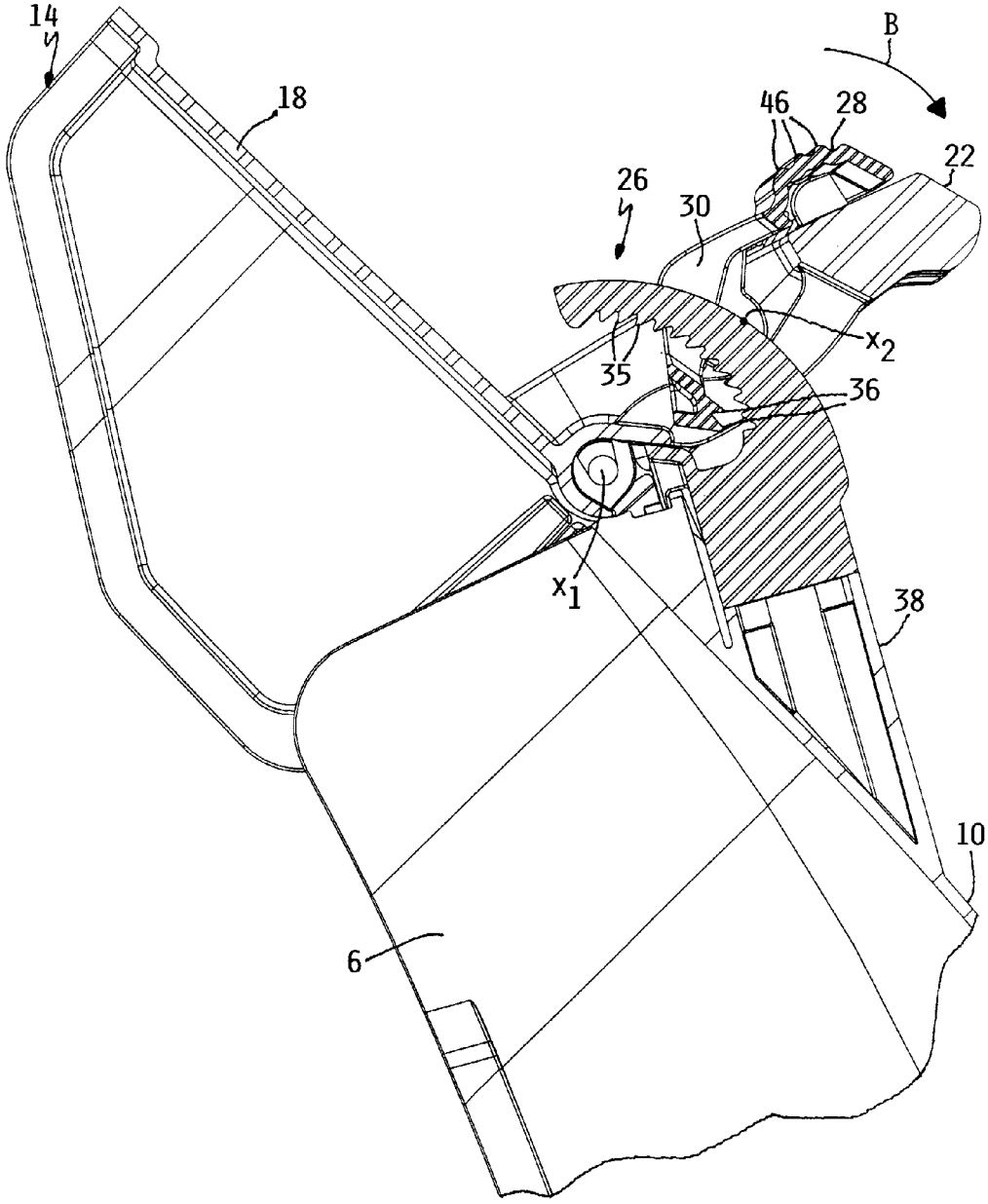
FIG. 5 is a cross sectional view similar to FIG. 4, but showing the deflector latch in a disengaged position.

The operator can selectively pivot latch 26 into the disengaged position shown in FIG. 5. This is done simply by placing the operator's hand atop handle 16 with the operator's fingers overlying and curling around head 28 of latch 26. If the operator then simply squeezes his or her hand closed by curling the fingers of his or her hand more tightly towards the palm of his or her hand, head 28 of latch 26 will be depressed until it abuts the top of rear wall 22 of handle 16. This rotates or pivots latch 26 in the direction shown by the arrow B in FIG. 5 until detents 36 have disengaged teeth 35 of rack 34. Rotation in the direction of the arrow B is stopped out by the abutment of head 28 of latch 26 on rear wall 22.

The shape of head 28 of latch 26 is designed to complement the shape of rear wall 22 of handle 16. As shown in FIG. 5, when latch 26 is disengaged and head 28 of latch 26 abuts with the top of rear wall 22 of handle 16, head 28 of latch 26 has a compound shape that generally matches the compound shape on the underside of rear wall 22 of handle 16. Thus, head 28 of latch 26 and rear wall 22 of handle 16 form a unitary hand grip when latch 26 is disengaged that feels much the same to the operator on both the top and the bottom when the operator is holding it. Head 28 of latch 26 may have a plurality of lateral knurls or ribs 46 to provide a gripping surface for the operator's hand to better prevent the operator's hand from slipping on latch 26.

In any event, with latch 26 in the disengaged position and head 28 of latch 26 abutted against the top of rear wall 22 of handle 16, the operator can use handle 16 to pivot deflector 14 up or down to a new desired position to thereby adjust the trajectory of the snow stream being thrown by chute 6. Obviously, if deflector 14 is already at the end of its range of motion as shown in the full up position of FIG. 5, deflector 14 can only be pivoted downwardly. If deflector 14 is in an intermediate position between its full up or full down positions, deflector 14 can be pivoted immediately in either direction. This happens because detents 36 on latch 26 are manually held out of engagement with teeth 35 on rack 34 when the operator has depressed or squeezed head 28 of latch 26 against the top of rear wall 22 of handle 16.

Once deflector 14 is pivoted to a desired adjusted position, the operator need only release handle 16. This releases latch 26 which resets to its engaged position by virtue of the biasing force of springs 40. Detents 36 on latch 26 reengage with different teeth 35 on the underside of rack 34. This reengagement latches or locks deflector 14 in place in its adjusted position. Thus, deflector 14 will stay where it is even though the force of the snow acting against deflector 14 might otherwise try and raise or push deflector 14 up to its full up position.

Latch 26 preferably locks deflector 14 against movement in only one direction, namely upward movement of deflector 14 about horizontal axis $x_1$ in a direction raising the trajectory of the snow stream. Positive locking by latch 26 is required in this direction since the force of the snow stream acting against deflector 14 tends to naturally pivot deflector 14 upwardly. Detents 36 are shaped relative to teeth 35 on rack 34 to provide such a positive lock. Upward pivoting motion of deflector 14 causes detents 36 to be forced more firmly into engagement with the grooves between adjacent teeth.

However, the user can pivot deflector 14 downwardly about horizontal axis $x_1$ to lower the trajectory of the snow stream without needing to disengage latch 26, though obviously the user can still pivot latch 26 to disengage detents 36 prior to lowering deflector 14. But, even without disengaging latch 26, the user can still push forwardly on handle 16 to lower the trajectory of the snow stream. Detents 36 are shaped to simply ratchet over teeth 35 on rack 34 when deflector 14 is being pivoted downwardly about horizontal axis $x_1$. However, if so desired, detents 36 could be shaped relative to teeth 35 to provide a positive lock against movement of deflector 14 in both upward and downward directions rather than a lock against only upward movement of deflector 14.

Deflector control 2 of this invention retains the simplicity of a simple handle physically attached to back wall 18 of deflector 14. In fact, handle 16 itself is integrally molded to back wall 18 of deflector 14. But, a positive latch 26 is now provided that is able to positively lock deflector 14 in the adjusted position. This allows deflector 14 to be substantially friction free relative to chute 6 so that the operator can very easily move or pivot deflector 14 up or down. Latch 26 is a simple pivotal latch contained in hand grip space 24 of handle 16 with latch 26 being released whenever the operator grips rear wall 22 of handle 16 and squeezes the fingers of his or her hand closed. Thus, latch 26 is simple and foolproof in operation.

Various modifications of this invention will be apparent to those skilled in the art. Accordingly, this invention is to be limited only by the appended claims.

I claim:

1. An improved snowthrower of the type having a chute rotatable about a substantially vertical axis for directing a snow stream, a deflector carried on the chute with the deflector being pivotal relative to the chute for adjusting the trajectory of the snow stream, and a control on the snowthrower for operating the deflector, wherein the improvement relates to the control which comprises:

(a) a handle on the deflector to allow an operator to grip the handle to pivot the deflector;

(b) a movable latch carried on the deflector, the latch being movable on the deflector between an engaged position in which the deflector is locked against being pivoted at least upwardly and a disengaged position in which the deflector is free to be pivoted upwardly, wherein the latch is T-shared having a head and a stem projecting from one side of the head with the stem of the latch being narrower than the head of the latch;

(c) a toothed rack fixed on the chute, wherein the toothed rack extends through a slot in the stem of the latch, and wherein the stem cooperates with the toothed rack to hold the deflector in place on the chute when the latch is in the engaged position; and (d) wherein the latch is configured and oriented relative to the handle such that the latch is moved between the engaged and disengaged positions thereof when the operator grips both the head of the latch and the handle with one hand and the operator squeezes the fingers of the gripping hand closed on the handle.

2. The snowthrower of claim 1, wherein the head abuts atop a rear wall of the handle when the fingers of the operator's gripping hand are squeezed closed and the latch has been placed in its disengaged position.

3. The snowthrower of claim 2, wherein the head of the latch is approximately as wide as the length of the rear wall of the handle.

4. The snowthrower of claim 2, wherein the head of the latch has a top which has a gripping surface.

5. The snowthrower of claim 4, wherein the gripping surface is provided by a plurality of ribs on the top of the head of the latch.

6. The snowthrower of claim 2, further including at least one spring extending between the latch and the handle for biasing the latch in a direction which causes the stem of the latch to engage the toothed rack.

7. The snowthrower of claim 6, wherein the at least one spring is positioned between an underside of the head of the latch and a top of the rear wall of the handle.

8. The snowthrower of claim 1, wherein the stem has at least one detent shaped to engage between some of the teeth in the toothed rack when the latch is in the engaged position thereof.

9. The snowthrower of claim 1, wherein the toothed rack is curved and extends over an arc relative to the deflector and the handle.

10. The snowthrower of claim 9, wherein the arc is approximately equal to a maximum angular range of motion of the deflector on the chute.

11. An improved snowthrower of the type having a chute rotatable about a substantially vertical axis for directing a snow stream, a deflector carried on the chute with the deflector being pivotal relative to the chute for adjusting the trajectory of the snow stream, and a control on the snowthrower for operating the deflector, wherein the improvement relates to the control which comprises:

(a) a U-shaped handle on the deflector with the handle comprising a pair of spaced side walls and a rear wall with the rear wall being spaced behind a back wall of the deflector and with the side walls of the handle joining the rear wall of the handle to the back wall of the deflector;

(b) a locking member fixed to a back of the chute, the locking member extending through the handle between the side walls thereof and in front of the rear wall of the handle such that the handle traverses back and forth over the locking member as the deflector is adjusted;

(c) a movable latch carried on the handle, the latch being configured to interengage with the locking member to hold the deflector in place when the latch is moved into an engaged position, the latch being selectively movable by the operator into a disengaged position in which the interengagement between the latch and the locking member is broken to thereby permit the deflector to be adjusted at least upwardly.

12. The snowthrower of claim 11, wherein the interengagement between the latch and the locking member is a toothed interengagement.

13. The snowthrower of claim 12, wherein the locking member comprises a toothed rack having a plurality of teeth disposed along a portion thereof, and wherein the latch comprises at least one detent shaped to engage in grooves between the teeth of the toothed rack.

14. The snowthrower of claim 13, wherein the portion of the toothed rack carrying the teeth is curved over an angular extent approximately the same as an angular range of motion of the deflector.

15. A snowthrower, which comprises:

(a) a frame;

(b) snow removal components on the frame for gathering snow from the ground and for throwing the gathered snow in a snow stream away from the snowthrower;

(c) a rotatable chute on the frame that directs the snow stream in different directions depending on the rotational position of the chute;

(d) a pivotal deflector atop the chute for adjusting an angle of trajectory of the snow stream;

(e) a handle assembly on the snowthrower having at least one upwardly and rearwardly extending handle tube connected to the frame;

(f) a U-shaped handle fixed to a back wall of the deflector;

(g) a pivotal latch carried on the handle;

(h) a toothed rack carried on a back wall of the chute;

(i) a spring biasing the latch such that a detent on the latch normally engages with the rack with the interengagement between the detent and the rack holding the deflector in an adjusted position; and (j) wherein the latch is selectively pivoted to remove the detent from the rack and thereby permit pivotal adjustment of the deflector at least upwardly whenever the operator grips the handle and squeezes the fingers of the gripping hand closed.

* * * * *

UNITED STATES PATENT AND TRADEMARK OFFICE

CERTIFICATE OF CORRECTION

PATENT NO. : 7,472,500 B2
APPLICATION NO. : 11/650362
DATED : January 6, 2009
INVENTOR(S) : Donald M. White, III et al.

It is certified that error appears in the above-identified patent and that said Letters Patent is hereby corrected as shown below:

Col. 6, Line 2, change “T-shared” to --T-shaped--.

Signed and Sealed this

Twenty-first Day of April, 2009

JOHN DOLL
*Acting Director of the United States Patent and Trademark Office*